United States Patent [19]

Kawaguchi

[11] 4,425,718

[45] Jan. 17, 1984

[54] APPARATUS FOR DEVELOPMENT AND FIXATION OF DYES WITH A PRINTED TEXTILE SHEET BY APPLICATION OF MICROWAVE EMANATION

[75] Inventor: Bunshiro Kawaguchi, Kyoto, Japan

[73] Assignee: The Ichikin, Ltd., Japan

[21] Appl. No.: 258,889

[22] Filed: Apr. 30, 1981

[51] Int. Cl.[3] ..... F26B 3/34

[52] U.S. Cl. ..... 34/1; 34/68; 219/10.55 R; 68/5 C; 68/5 E; 68/13 R

[58] Field of Search ..... 34/1, 68, 147, 155; 68/5 C, 5 D, 5 E; 118/58, 620; 219/10.55 R, 10.55 A, 10.55 M

[56] References Cited

U.S. PATENT DOCUMENTS

| | | | |
|---|---|---|---|
| 2,484,527 | 10/1949 | Rhoads et al. | 34/77 |
| 3,491,457 | 1/1970 | Schreiber et al. | 34/1 |
| 3,718,082 | 2/1973 | Lipoma | 219/10.55 R |
| 3,859,163 | 1/1975 | Haythornthwaite | 162/198 |
| 4,219,942 | 9/1980 | Coliva | 34/155 |
| 4,274,209 | 6/1981 | Kawaguchi | 34/68 |

*Primary Examiner*—Larry I. Schwartz

*Attorney, Agent, or Firm*—Lerner, David, Littenberg, Krumholz & Mentlik

[57] ABSTRACT

A printed textile sheet is continuously passed through a chamber while being entrained in a flat, tensionless state on a horizontal section of a flexible endless carrier belt whose moisture content and temperature are positively maintained at selected values so that moisture content of the textile sheet, in particular at printed spot patterns, can be fairly equalized before and during application of steam and microwave emanation for uniform development and fixation of dyes over the entire area of the textile sheet.

13 Claims, 3 Drawing Figures

APPARATUS FOR DEVELOPMENT AND FIXATION OF DYES WITH A PRINTED TEXTILE SHEET BY APPLICATION OF MICROWAVE EMANATION

BACKGROUND OF THE INVENTION

The present invention relates to an apparatus for development and fixation of dyes on a printed textile sheet by appplication of microwaves, and more particularly relates to improvement in continuous aftertreatment of a printed textile sheet under emanation of microwaves for uniform and ideal colour fixation and development.

Colour fixation and development on a textile sheet has long been carried out by firstly passing the textile sheet through a dryer and, thereafter, subjecting same to steam heating.

For aftertreatment of a dyed textile sheet in general, it was already proposed to subject the dyed textile sheet to emanation of microwaves in wet state. Here the term "microwaves" refers to electro-magnetic waves having frequencies in a range from 300 to 30,000 MHz.

Microwaves have a wide variety of advantages particular when used for treatment of a textile sheet in wet state. First, they permeate into and heat the textile sheet very swiftly. Secondly, they can be selectively absorbed in an object with large dielectric loss and heat only necessary sections of the object, since their heat generation is caused by dielectric loss. There is almost no heating of unnecessary sections of the object, thereby well avoiding extravagance of thermal energy generated by microwave emanation. Thirdly, when an object is exposed to microwaves, the object also generates heat by itself and such heat naturally raises the temperature of the ambient atmosphere. As a consequence, the amount of the thermal energy otherwise needed for heating the ambient atmosphere for the treatment can be greatly reduced. Fourthly, microwaves usually cause almost simultaneous temperature rise at different sections of an object exposed to them. As a consequence, regional variation in temperature within the object can be significantly minimized and this leads to ideal and uniform heating of the object. Finally, heating condition can easily and swiftly controlled in accordance with demands in the actual treatment merely by adjusting the output voltage for microwave generation.

Emanation of microwaves onto a textile sheet causes ionic conduction and dipole rotation of the fibrous materials composing the textile sheet, water and aqueous agents contained in the textile sheet. This is believed to results in swift and uniform heating of the textile sheet exposed to microwaves.

Based on recognition of these advantages, various systems have been proposed in the field of textile treatment. One example of such proposals is disclosed in U.S. Pat. No. 4,274,209 (EPC patent application No. 79850116.9) filed by the inventor (applicant) of the present invention on Dec. 28, 1979. In the case of this proposed system, a textile sheet in the form of a roll is placed within a confined chamber replete with saturated or overheated steam, and rotated under concurrent emanation of microwaves.

This proposed system well makes use of the advantages inherent to microwaves. However, since the textile sheet in this system is exposed to steam and microwaves in the form of a roll, there is a significant difference in treatment effect between the section of the textile sheet close to the core of the roll and the section close to the periphery of the roll, since steam and microwaves both have easier access to the peripheral sections of the roll. As a consequence, one cannot expect uniform treatment effect over the entire length of the textile sheet.

In order to remove this disadvantage, a more dynamic system has also been proposed by the inventor of the present invention. In accordance with this dynamic system, a pair of rolls of a textile sheet are placed within a confined chamber replete with saturated or overheated steam, and the textile sheet is continually transferred from one roll to another and vice versa under concurrent emanation of microwaves.

This improved system well solves the uniformity problem. However, since the textile sheet has to be kept, even provisionally, within the confined chamber during the treatment, this system is applicable to the so-called batch process only. In other words, this system is quite unsuited for any continuous textile process in which a textile sheet has to be continually transferred from station to station.

In addition, when a printed textile sheet is subjected to any aftertreatment, it is preferred that at least the printed surface of the textile sheet should stay out of any contact with other objects such as guide rollers untill colour fixation and development are finalized. From this point of view, it is rather undesirable to prepare the textile sheet in a roll form before emanation of microwaves. It is well known in the art that temperature and moisture condition of a printed textile sheet pose delicate influence on its dye development and fixation by microwave emanation. Colour size spots are usually printed on the textile sheet with time phase during printing process and such time-phased printing of colour size spots is apt to cause moisture variation over the entire area of the textile sheet. Variation in moisture and temperature further poses serious influence on thermal effect of microwave emanation. So, for ideal development and fixation of dyes, the moisture content of the textile sheet needs to be equalized over the entire area before exposure to microwaves. It is also well known that variation in moisture content of a textile sheet is greatly swayed by presence of tension in the textile sheet. In order to remove this variation, it is preferable to advance the textile sheet with minimum tension through the treatment chamber.

SUMMARY OF THE INVENTION

It is one object of the present invention apply an aftertreatment by microwave emanation, as a part of a continous textile process, to a printed textile sheet with highly uniform colour fixation and development.

It is another object of the present invention to carry out an aftertreatment by microwave emanation of a printed textile sheet without any contact of the printed surface with other objects such as guide rollers.

It is the other object of the present invention to remove variation in moisture of a textile sheet before exposure to microwave emanation in development and fixation of dyes on a printed textile sheet.

It is a further object of the present invention to subject a printed textile sheet to microwave emanation in a substantially tensionless state.

In accordance with the basic aspect of the present invention, a printed textile sheet is advanced in a substantially tensionless, horizontal state to a stage of microwave emanation arranged in a confined chamber while being entrained on a circulating and flexible carrier belt in order to be subjected to contact with steam and emanation of microwaves.

In one preferred embodiment of the present invention, contact with steam proceeds concurrently with emanation of microwaves.

In another preferred embodiment of the present invention, the textile sheet is exposed to microwaves after full contact with steam.

In the other preferred embodiment of the present invention, steam for contact with the textile sheet is generated by microwave generation.

DESCRIPTION OF THE PREFERRED EMBODIMENTS

Figure 1:
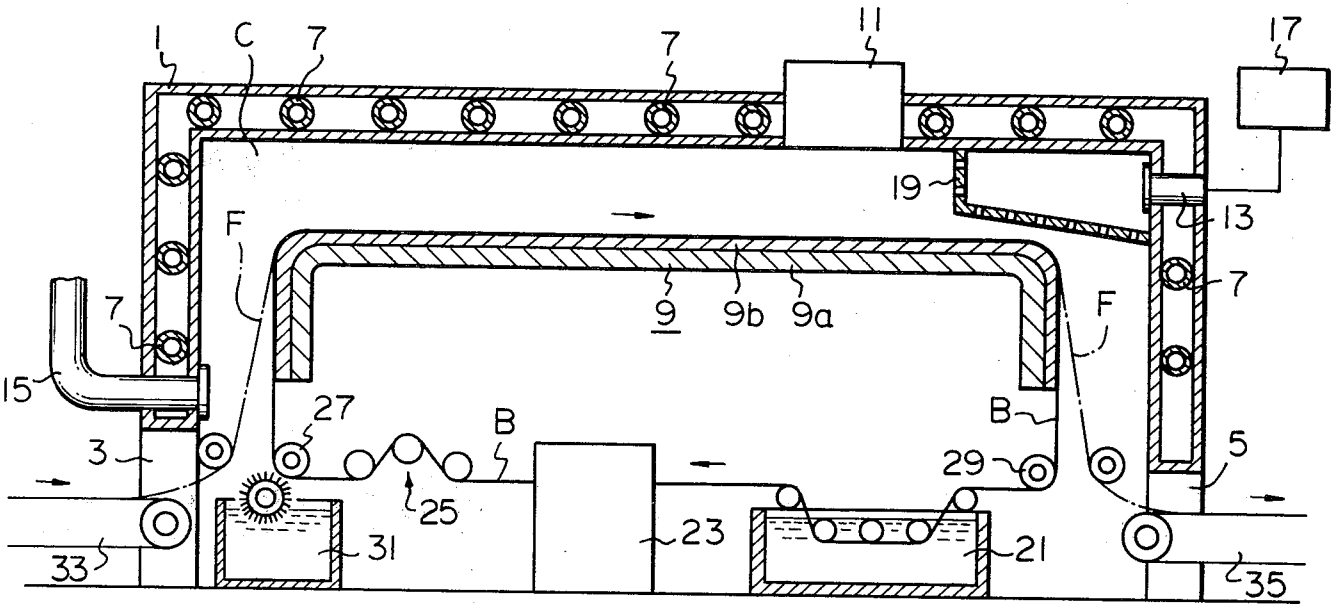
FIG. 1 is a side view, partly in section, of the first embodiment of the apparatus in accordance with the present invention.

In the following description, elements used for different embodiments but substantially same in construction and function are designated with same reference numerals and symbols.

The first embodiment of the apparatus in accordance with the present invention is shown in FIG. 1, in which the apparatus includes a housing 1 defining a substantially confined chamber C for aftertreatment of a printed textile sheet F. In this case, the appratus is used in combination with a screen printer (not shown). For introduction of the textile sheet F into the confined chamber C, an inlet 3 is formed at the one longitudinal end of the housing 1. In the same way, an outlet 5 is formed at the other longitudinal end of the housing 1 for delivery of the textile sheet F from the confined chamber C.

The walls of the housing 1 preferably have a hollow double construction at least in the sections surrounding the confined chamber C, and a number of heating tubes 7 preferably run through the inner spaces. The heating tube 7 allows passage of any proper heating medium such as steam therethrough in order to keep the temperature within the confined chamber C, and prevent dewing on the wall surfaces.

A horizontal bulkhead 9 is arranged at a proper level within the confined chamber C and divides the latter into upper and lower rooms. This horizontal bulkhead 9 also preferably has a double construction made up of a lower rigid base 9*a* and an upper shelter plate 9*b* which blocks free passage of microwaves through the bulkhead 9. At longitudinal ends the bulkhead 9 is preferably provided with vertically extending sections for controlled running of the later described carrier belt.

At least one emanator 11 of microwaves is secured to the housing 1 whilst opening in the upper room of the confined chamber C.

In order to render the confined chamber C replete with steam, supply and exhaust conduits 13 and 15 are mounted to the housing 1 whilst opening in the confined chamber C. In the case of the illustrated embodiment, the supply conduit 13 opens at a position on the side of the outlet 5 whereas the exhaust conduit 15 opens at a position on the side of the inlet 3 for the textile sheet F. The supply conduit 13 is coupled to a given supply source 17 of saturated or overheated steam. Further, the opening of the supply conduit 13 is preferably encompassed by a perforated plate 19 which allows free passage of steam but not microwaves. Use of such a perforated plate 19 well prevents wasteful dissipation and dangerous leakage of microwaves via the steam system.

An endless carrier belt B is arranged within the confined chamber C for continual circulation partly in sliding contact with the top surface of the horizontal bulkhead 9. This carrier belt B is made of a flexible material such as felt which is absorptive of water or other liquid substance. In the lower room of the confined chamber C, this carrier belt B advances through a wet bath 21 and a heater 23 in order to be always kept at prescribed temperature and humidity. The carrier belt B further engages with a tension adjuster 25 in order to be properly tensed during its circulations. Guide rollers 27 and 29 are arranged in order to keep the fixed circulation course of the carrier belt B. Either of the guide rollers 27 and 29 may be coupled to a given drive motor (not shown) so that the circulation speed of the carrier belt B can be positively controlled. The carrier belt B is further brought into contact with a size applicator 31 after heating.

A carrier belt 33 from the preceding printing station terminates near the inlet 3 to the confined chamber C and a carrier belt 35 to the next operational station starts near the outlet 5 from the confined chamber C.

Before the introduction of the printed textile sheet F, emanation of microwaves and supply of steam are started in order to render the confined chamber C replete with microwaves and steam. Next, the textile sheet F brought from the preceding screen printing station by the carrier belt 33 is introduced into the confined chamber C via the inlet 3 and entrained on the carrier belt B on the top surface of the horizontal bulkhead 9 in order to travel towards the outlet 5 in contact with steam under emanation of microwaves. The size applied to the surface of the carrier belt B by the size applicator 31 enables tensionless but snug surface contact of the textile sheet F with the carrier belt B. The textile sheet F is kept at moderate temperature and humidity during its travel through the confined chamber C due to contact with the carrier belt B which is soaked and heated during its running through the lower room of the confined chamber C. Emanation of microwaves fills the confined chamber C with hot steam of 100° to 200° C. temperature.

In the case of the illustrated embodiment, the textile sheet F with the carrier belt B advances in the upper room of the confined chamber from the inlet to outlet side whereas steam flows in the upper room from the outlet to inlet side. This counter-march of the textile sheet F raises thermal efficiency of the steam greatly. The flowing direction of the steam, however, may be same as the advancing direction of the textile sheet F in the upper room of the confined chamber C.

When the apparatus for the present invention is used in combination with a roll printer, the printed textile sheet F shall be continually unwound from a roll of the printed cloth in the printing station and led to the inlet 3 of the housing 1 in any known manner.

On the apparatus of the present invention, the printed textile sheet is advanced through the confined chamber C substantially without any tension while being kept in a state moderating soaked and heated, the emanated microwaves instantly permeate into the structure of the textile sheet in order to effectively generate heat due to their dielectric loss. Selective absorption of the microwaves by the textile sheet ends in efficient utilization of heat for the aftertreatment of the printed textile sheet. These concur to bring about improved fixation and development of colours printed on the textile sheet. The process is greatly streamlined due to removal of the separate drying operation. Advanced rear surface contact of the printed textile sheet with the carrier belt which is positively maintained at selected temperature and moisture content effectively removes variation in moisture over the entire area of the textile sheet before the microwave emanation.

In the case of the first embodiment, the textile sheet F was exposed to the microwaves concurrently with contact with the steam in the confined chamber C. Despite the effective utilization of thermal energy, this concurrent system is liable to cause uneven colour fixation and development on the textile sheet obtained. This is in particular significant when the present invention is applied to aftertreatment of a textile sheet printed by screen printing.

In the case of screen printing, a number of patterns of different colours are printed in the form of printing size on a textile sheet subsequently and intermittently. This time phased printing procedure causes difference in moisture content between a early printed size pattern and a late printed size pattern due to evaporation. The large number of patterns to be usually printed in screen printing connects to big difference in moisture content. More specifically, the moisture content of a size pattern printed during the earlier stage of screen printing is by far smaller, due to evaporation, than that of a size pattern printed during the later stage of screen printing.

As a consequence, a printed textile sheet just arriving from the preceding printing station includes size patterns of different moisture contents. Heating effect by microwave emanation is greatly swayed by moisture content of the object exposed to microwaves. Therefore, when a printed textile sheet is directly subjected to microwave emanation concurrently with contact with steam, heating effect by microwave emanation varies from pattern to pattern on the textile sheet. This naturally results in uneven colour fixation and development on the textile sheet. In order to obviate such uneveness, moisture content of the textile sheet should be adjusted so as to be uniform over the entire area before exposure to microwaves.

Figure 2:
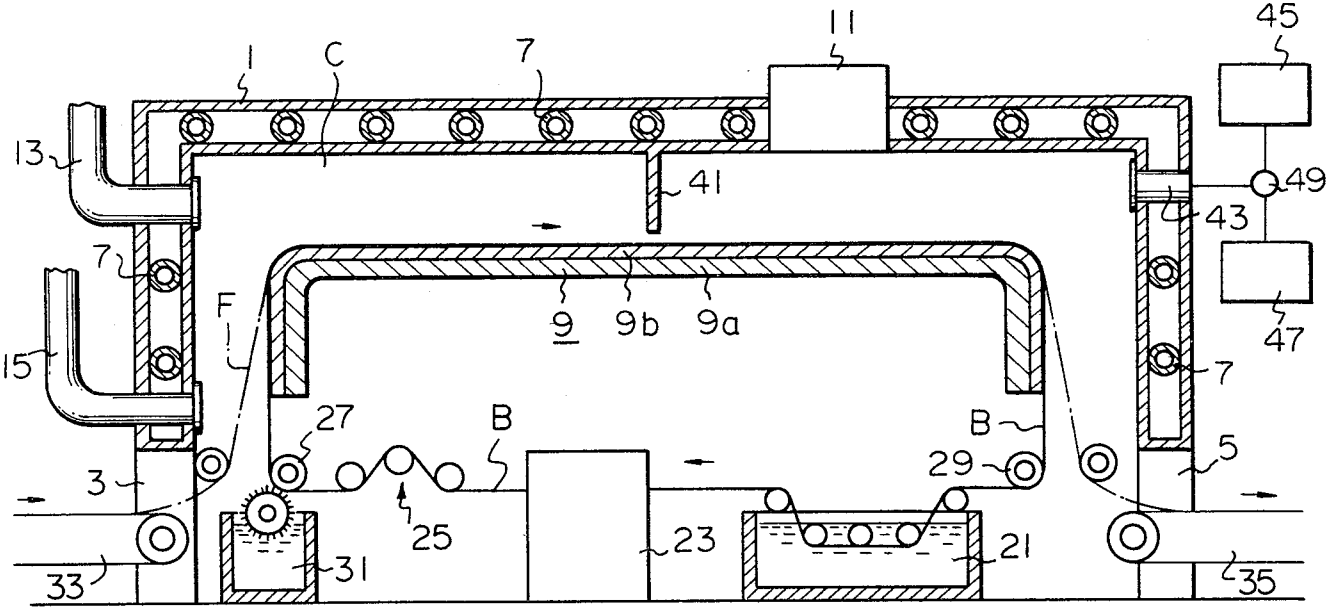
FIG. 2 is a side view, partly in section, of the second embodiment of the apparatus in accordance with the present invention.

The second embodiment of the apparatus in accordance with the present invention well suffices this requirement and is shown in FIG. 2.

About the middle of the length of the confined chamber C, a vertical bulkhead 41 extends from the housing 1 towards the top surface of the horizontal bulkhead 9 whilst allowing free passage of the textile sheet F with the carrier belt B. This vertical bulkhead 41 divides the upper room of the confined chamber C further into upstream and downstream rooms along the traveling path of the textile sheet F. The upstream room forms a sort of moisture adjusting room.

The steam supply and exhaust conduits 13 and 15 in this embodiment both open in the upstream room whereas the emanator 11 opens in the downstream room. A further supply conduit 43 preferably opens in the downstream room and is selectively coupled, via a shifter valve 49, to a supply source of steam 45 and a supply source of dry air 47. Depending on the material used for the textile sheet F, either steam or dry air is supplied to the downstream room via the supply conduit 43 by operating the shift valve 49.

In operation, the textile sheet F from the printing station is first brought into the upstream moisture adjusting room replete with steam supplied via the conduit 13 so that moisture contents of different patterns on the textile sheet F should be substantially equalized and the textile sheet F should be soaked sufficiently. Next, the textile sheet F is exposed to microwaves in the downstream room for heating. Heating by microwave emanation can be carried out quite uniformly over the entire area of the textile sheet due to the equalized moisture content, thereby assuring ideally uniform colour fixation and development.

Figure 3:
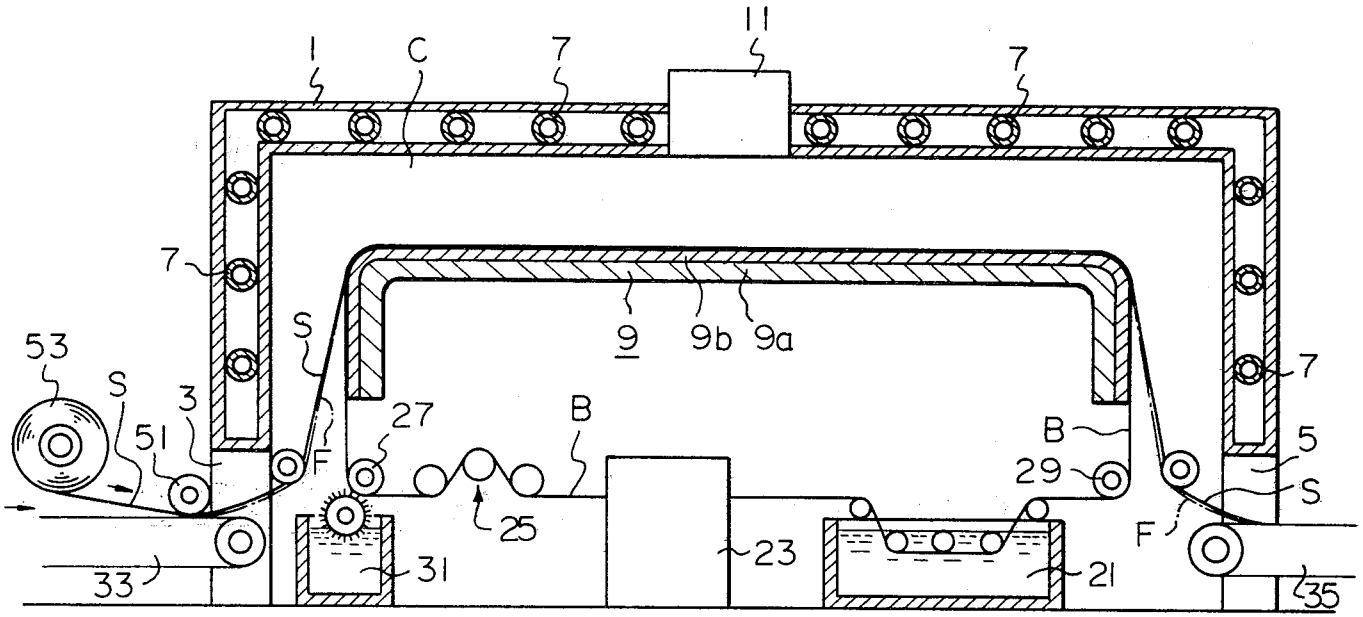
FIG. 3 is a side view, partly in section, of the third embodiment of the apparatus in accordance with the present invention.

In the case of the first and second embodiments, the steam to contact the textile sheet is supplied into the confined chamber C by means of the steam circulation system 13 and 15. The third embodiment of the apparatus in accordance with the present invention shown in FIG. 3 employs a different system for generation of the steam. That is, generation of the steam is caused by emanation of the microwaves. This system greatly simplifies the construction of the apparatus by omitting the steam supply system used for the foregoing embodiments. In addition, dissipation of the steam generated is well prevented in order to assure most efficient utilization of thermal energy.

On the inlet side of the housing 1, a roll 53 of a flexible sheet S is placed over the carrier belt 33 from the preceding printing station. Preferably, this flexible sheet S takes the form of an elongated polyethylene film or densely woven cloth which allows free passage of microwaves but not steam. The woven cloth may contain glass or ceramic fibers. The flexible sheet S is delivered from the roll 53, led into the confined chamber C via a guide rollers 51 arranged near the inlet 3, and superimposed on the textile sheet F for concurrent running. Since the carrier belt B is soaked before contact with the textile sheet F, the flexible sheet S absorbes moisture from the carrier belt B through the textile sheet F as soon as the three come in contact on the horizontal bulkhead 9. As the wet flexible sheet S advances towards the emanator 11 in the confined chamber C, emanation of the microwaves causes evaporation of the moistured in the flexible sheet and the steam so generated is allowed to permeate into the textile sheet F. Since the steam so generated is not allowed to move into the space over the flexible sheet S, dissipation of thermal energy is well prevented, and the thermal energy provided by microwave emanation is quite efficiently utilized. Since the textile sheet F is a little pressed between the flexible sheet S and the carrier belt B during exposure to microwaves, this system is well suited for aftertreatment of towels, blankets and cloths made of bulky yarns which have fluffs on the surface. Presence of fluffs is liable to cause uneven microwave emanation effect.

I claim:

1. An apparatus for development and fixation of dyes on a printed textile sheet by application of microwave emanation comprising:

a housing forming therein a chamber which has an inlet and an outlet for said textile sheet;

an endless, flexible carrier belt arranged within said chamber and having a substantially horizontal section adapted for supporting said textile sheet in a flat, tensionless state;

means for driving said carrier belt to cause travel of said textile sheet supported thereby from said inlet to said outlet;

means for positively maintaining said carrier belt at selected temperature and moisture content;

means for applying microwave emanation to said textile sheet during said travel thereof; and means for subjecting said textile sheet to steam during said travel thereof.

2. An apparatus as claimed in claim 1, wherein said subjecting means comprises steam supply and exhaust conduits both opening into said chamber, and steam flows within said chamber from said steam supply conduit to said steam exhaust conduit.

3. An apparatus as claimed in claim 2, wherein said steam supply conduit opens into said chamber at a position near said outlet, said steam exhaust conduit opens into said chamber at a position near said inlet, and said steam flows in a direction substantially opposite to the direction of said travel of said textile sheet.

4. An apparatus as claimed in claim 2 or 3 further comprising a perforated plate mounted within said housing over the opening of said steam supply conduit, said perforated plate allowing free passage of steam but not said microwave radiation therethrough.

5. An appartus as claimed in claim 1 further comprising a bulkhead attached to said housing within said chamber, said bulkhead dividing said chamber into upstream and downstream rooms arranged in succession along the path of travel of said textile sheet, said subjecting means comprising steam supply and steam exhaust conduits both opening in said upstream room of said chamber, and said applying means applying microwave emanation to said textile sheet only in said downstream room of said chamber.

6. An apparatus as claimed in claim 5 further comprising a further steam supply conduit opening into said downstream room of said chamber and a shift valve, said shift valve for selectively coupling said further steam supply conduit to separate supply sources of steam and dry air.

7. An apparatus as claimed in claim 1, further comprising a flexible sheet traveling with said textile sheet through said chamber, and flexible sheet allowing free passage therethrough of microwave but not steam, and said flexible sheet being in contact with the printed side surface of said textile sheet.

8. An apparatus as claimed in claim 1, 2, 5 or 7, wherein the walls of said housing are of a hollow double walled construction at least in the sections thereof forming said chamber.

9. An apparatus as claimed in claim 8, wherein a plurality of heating tubes are arranged in the hollow between the walls of said double walled construction.

10. An apparatus as claimed in claim 1, 2 or 7, wherein said housing further comprises a bulkhead which divides said chamber into upper and lower rooms, said endless carrier belt circulates around said bulkhead with said horizontal section in sliding contact with the top surface of said bulkhead, and said textile is transported by said carrier belt through said upper room.

11. An apparatus as claimed in claim 10, wherein said temperature and moisture content maintaining means comprises a wet bath and a heater, said wet bath and said heater being arranged in said lower room of said chamber proximate to said endless carrier belt.

12. An apparatus as claimed in claim 10, further comprising a size applicator disposed in said lower room of said confined chamber proximate to said endless carrier belt, said size applicator for applying size to said carrier belt before contact with said textile sheet.

13. An apparatus as claimed in claim 10, wherein said bulkhead comprises a rigid base and shelter plate fixedly secured thereto which blocks passage of microwave radiation therethrough.

* * * * *

UNITED STATES PATENT AND TRADEMARK OFFICE

CERTIFICATE OF CORRECTION

PATENT NO. : 4,425,718

DATED : January 17, 1984

INVENTOR(S) : Bunshiro Kawaguchi

It is certified that error appears in the above-identified patent and that said Letters Patent are hereby corrected as shown below:

Column 8, line 6, "and" should read --said--.

Signed and Sealed this

Tenth Day of April 1984

[SEAL]

Attest:

GERALD J. MOSSINGHOFF

Attesting Officer

Commissioner of Patents and Trademarks